US005429537A

United States Patent [19]

Seith

[11] Patent Number: 5,429,537

[45] Date of Patent: Jul. 4, 1995

[54] PERSONAL FLOTATION DEVICE

[76] Inventor: Nancy Seith, 8800 Carmichael Dr., Chester Township, Geauga County, Ohio 44026

[21] Appl. No.: 180,042

[22] Filed: Jan. 11, 1994

Related U.S. Application Data

[62] Division of Ser. No. 839,919, Jan. 11, 1994, Pat. No. 5,277,636.

[51] Int. Cl.[6] ..... A63C 15/03

[52] U.S. Cl. ..... 441/76

[58] Field of Search ..... 441/69, 76, 77, 78; 440/13, 17, 21, 22

[56] References Cited

U.S. PATENT DOCUMENTS

| | | | |
|---|---|---|---|
| 216,234 | 6/1879 | Soule . | |
| 1,533,023 | 4/1925 | Meredith . | |
| 3,541,623 | 11/1970 | Duda | 441/76 |
| 3,566,427 | 3/1971 | Davis et al. | 441/76 |
| 3,750,203 | 8/1973 | Ceccato | 441/76 |
| 3,808,622 | 5/1974 | Webster . | |
| 3,835,494 | 9/1974 | Dougherty . | |
| 3,835,495 | 9/1974 | Dougherty . | |
| 4,034,430 | 9/1974 | Joyce . | |
| 4,037,280 | 7/1977 | Klepsch | 441/76 |
| 4,117,562 | 10/1978 | Schaumann . | |
| 4,261,069 | 4/1981 | Schaumann . | |
| 4,301,562 | 11/1981 | Durr . | |
| 4,527,984 | 7/1985 | Gilbert | 441/76 |

FOREIGN PATENT DOCUMENTS

| | | | |
|---|---|---|---|
| 618229 | 2/1961 | Italy | 441/77 |

*Primary Examiner*—Stephen P. Avila
*Attorney, Agent, or Firm*—F. L. Collins

[57] ABSTRACT

The present invention relates to personal flotation devices. The personal flotation devices are typically utilized in pairs with one or more poles for recreational or emergency rescue usage.

9 Claims, 3 Drawing Sheets

PERSONAL FLOTATION DEVICE

This application is a divisional of Ser. No. 07/839,919, now U.S. Pat. No. 5,277,636 issued Jan. 11, 1994.

BACKGROUND OF THE, INVENTION

1. This invention relates to a personal flotation device such as one which may be used for walking on water.

2. Description of the Art Practices

The first apparent use of personal flotation devices mounted to the feet is shown in Soule, U.S. Pat. No. 216,234 issued Jun. 3, 1879.

U.S. Pat. No. 3,835,494 issued Sep. 17, 1974, to Dougherty describes water walking pontoons which are useful for personal amusement. Dougherty's pontoons require that the user have the pontoon surround the legs up to and near the knee.

Webster, in U.S. Pat. No. 3,808,622 issued May 7, 1974, describes shoes for walking in water. In Webster, the shoes also require that the foot be placed within the elongated buoyant body member.

Joyce, in U.S. Pat. No. 4,034,430, issued Sep. 17, 1974 describes a pair of personal flotation devices which are held together by connecting means. The Joyce device also shows the insertion of the foot of the user into the flotation device.

Meredith, in U.S. Pat. No. 1,533,023, issued Apr. 7, 1925, describes a rudderless flotation device having foot means mounted such that the foot is above the surface of the flotation device, but completely encases the foot. Meredith also shows a hinged means for propelling the ski through the water.

U.S. Pat. No. 4,301,562, issued Nov. 24, 1981, discloses a further usage of the device wherein the: foot is inserted within the pontoon.

U.S. Pat. No. 4,117,562, issued Oct. 3, 1978, to Schaumann discloses a pair of buoyant flotation devices locked together by cords or other latching mechanism. The purpose of the latching mechanisms are to control the spread of the user's legs. A similar device is shown in U.S. Pat. No. 4,261,069, issued Apr. 14, 1981 to Schaumann. The water walker described in the later Schaumann patent employs an elongated indentation and an elongated protuberance to replace the locking mechanism, thereby controlling spread as in the earlier Schaumann patent.

The use of flotation devices is shown in an undated article, page 65, featuring David Kiner.

The present invention provides a flotation device which does not require the feet to be placed within the flotation device. A further feature of the present invention has two rudder members and disposed between the rudder members a means for trapping fluid when the device is directed by the user's foot in the aft direction.

A further feature of the present invention is to construct the personal flotation device such that an overhang, preferably a non-planar device is utilized to control the spread of the feet while the device is in use. Yet a further aspect of the present invention is a pole for enhanced propulsion of the personal flotation device.

SUMMARY OF THE INVENTION

There is described herein a personal flotation device comprising an elongated member with a forward end, an aft end, a starboard side, a port side, an upper surface and a lower surface; wherein the upper and lower surfaces are disposed such that the upper surface contains means above the surface of the upper surface for restraining a human foot and the lower surface contains at least two rudder members running between the forward end and aft end of the device and having disposed between the rudder members means for trapping a fluid when the device is directed in the aft direction.

A further feature of the invention is a personal flotation device comprising an elongated member with a forward end, an aft end, a starboard side, a port side, an upper surface and a lower surface; wherein the upper and lower surfaces are disposed such that the upper surface contains means above the surface of the upper surface for restraining a human foot, the device further having an overhang in relation to the means for restraining the foot such that the overhang extends outward from the starboard side when used with a right foot or outward from the port side when used with a left foot.

A further aspect of the invention is a personal flotation device comprising an elongated member with a forward end, an aft end, a starboard side, a port side, an upper surface and a lower surface; wherein the upper and lower surfaces are disposed such that the upper surface contains means above the surface of the upper surface for restraining a human foot and the lower surface contains at least two rudder members running between the forward end and aft end of the device and having disposed between the rudder members means for trapping a fluid when the device directed in the aft direction, the device further having an overhang in relation to the means for restraining the foot such that the overhang extends outward from the starboard side when used with a right foot or outward from the port side when used with a left foot.

The invention contemplates a pole comprising a shaft member having at one end thereof a handgrip and located substantially at the other end thereof a cupping mechanism.

Also described herein is a pole comprising a shaft member having at one end thereof a handgrip and located substantially at the other end thereof a flotation mechanism.

The present invention contemplates the combination of two opposite aforedescribed personal flotation devices and two of the aforedescribed poles. The invention further contemplates the method of a person utilizing the personal flotation device and/or the pole in water for business or recreational purposes.

DETAILED DESCRIPTION OF THE INVENTION

With reference to the afore-mentioned drawings, the present invention is described as follows.

Figure 1:
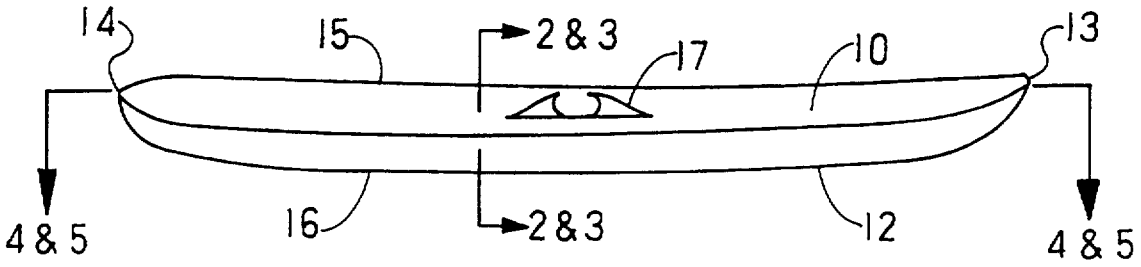
FIG. 1 shows a personal flotation device in accordance with the present invention. Typically, there will be 2 symmetrical (mirror image) but opposing personal flotation devices utilized by a user.

A personal flotation device is shown as FIG. 1. Typically, the personal flotation device will be utilized in pairs by a single human user.

In FIG. 1, the forward end of the personal flotation device (in this case, for the left foot), is shown at 13. The aft section of the personal flotation device is shown as 14. The starboard side of the flotation device is shown at 16, and the port side of the flotation device is shown at 15. The upper surface of the personal flotation device is shown as 10, and the lower surface is shown as 12.

Figure 2:
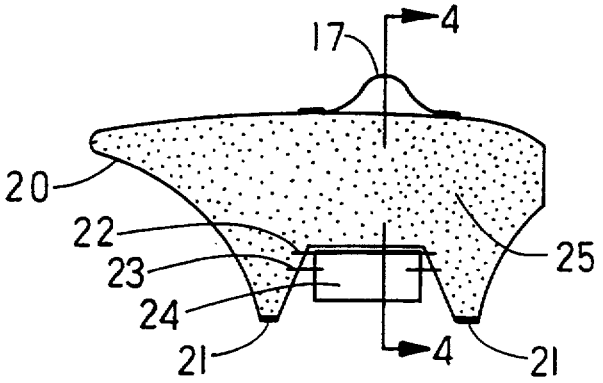
FIG. 2 shows a cross-sectional view taken across line 2—2.

FIG. 1 shows a foot-mounting means 17 mounted on the top of the flotation device. By placing the foot mounting device on top of the personal flotation device, more and more objects are accomplished. First, due to the unique flotation system, the present invention does not require that the user's leg be confined within the personal flotation device. Secondly, while it may appear that the personal flotation device would be less stable because of the higher center of gravity, the remainder of the invention, as shown in FIG. 2, later described, prevents the spread-eagle or splitting phenomenon. What is meant by the spread-eagle phenomenon is familiar to anyone who has stepped from a dock to a boat while maintaining one foot on the dock. As the water is fluid, the legs spread apart, and dire consequences often result. However, in the present invention, the use of the paired devices actually maintain the feet in a normal position without the risk of the spread-eagled effect.

The use of the unique flotation materials as later described herein also assist and allows the top mounting of the foot hold 17. As the flotation material is also effective in maintaining the device in an appropriate position, it is possible to minimize the width of the personal flotation device such that the users legs are in a more normal (standing or walking) position.

FIG. 2 shows a cross-section taken along line 2—2. The foothold 17 may be as used on a conventional water ski from which the user is towed by a boat. The features of the invention shown in FIG. 2 are a twin-hulled design with a arc surface 20 and twin hull rudders 21, which lie substantially below a hinged paddle means 24 with the paddles held in place by rod and spring means 22 such that when the personal flotation device is propelled in the forward direction the paddles are held against the bottom surface 12 and with the non hinged end of the paddle directed to the aft of the personal flotation device.

The paddles capture the fluid when the personal flotation device is directed in the aft direction and are prevented moving through a 180 degree arc by a paddle stop 23 to ensure fluid capture. The hinged paddle means 22 provide the ability to propel the personal flotation device in a forward direction when the opposite personal flotation device is pushed in the aft direction. The rudders 21 may be reinforced to allow the personal flotation device to be stood upon while on a solid surface, e.g. the bank of a lake. The rudders also assist in trapping and channelling the fluid in the desired direction.

Figure 3:
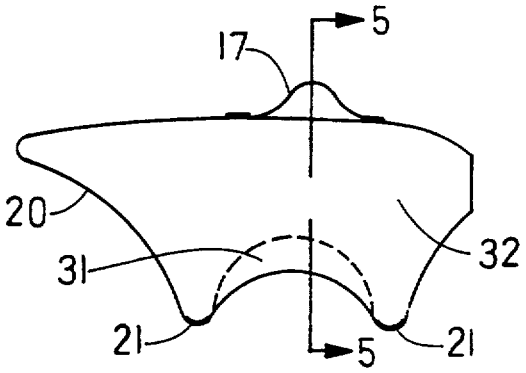
FIG. 3 shows a cross-sectional view taken across line 3—3.

In FIG. 2, 25 shows a buoyant flotation material such as a foam. Alternatively, in FIG. 3, 32 shows an air filled personal flotation device. The radius of the arc formed by 20 is typically between 40 and 60 cms, preferably 45 to 55 cms and most preferably 48 cms. The opposite radius on the other side of the personal flotation device is of similar proportions.

FIG. 3 shows a trapping mechanism 31 for capturing fluid without the need for a hinged mechanism. The trapping mechanism is typically a plurality of semicircular cups.

The twin-hulled rudders are preferably mounted such that the paddles or the cups do not contact the surface of the ground when the personal flotation device is on the shore. Stated otherwise, if the paddles were below the bottom of twin hulls 21, it would be subject to breakage. Thus, on relatively even ground, the paddles 24 are not subject to breakage due to the protective feature of twin hulls 21. The twin hulls run substantially the length of the personal flotation device from the forward to the aft end.

The overhang which is in a non-linear or non-planar perspective when taken from center point 25. The curved surface of the flotation device (FIG. 2 shows the left foot device) is non-planar, thereby having effective trapping water with the cup like action of the port side of the left personal device or the starboard side of the right flotation device.

A second important feature to the overhang is that the combination of the flotation material and the overhang allow for the greater support than a more flat surfaced device. The personal flotation device with the overhang and flotation material allows the user's ankles to be placed closer together when considering the relationship of the starboard side of the personal flotation device the left foot and the port side of the starboard personal flotation device.

FIG. 3 shows a cross-section comparable to FIG. 2. In FIG. 3, cups 31 are disposed to trap the fluid when using the first personal flotation device to propel the second personal flotation device through the fluid medium. While greater fluid resistance exists per the cross sectional view of the personal flotation device the solid mounting of the cups within the twin hull will offer greater ease in molding the device. That is, there is no need for moving parts on the device, and the device itself will be less subject to breakage. Consequently, using the cups of FIG. 3 rather than the paddles of FIG. 2, it is possible to extend the cups all the way to the bottom of the twin hull 21, or even beyond the twin hulls. Item 32 in FIG. 3 shows a hollow (air filled) personal flotation device.

Figure 4:
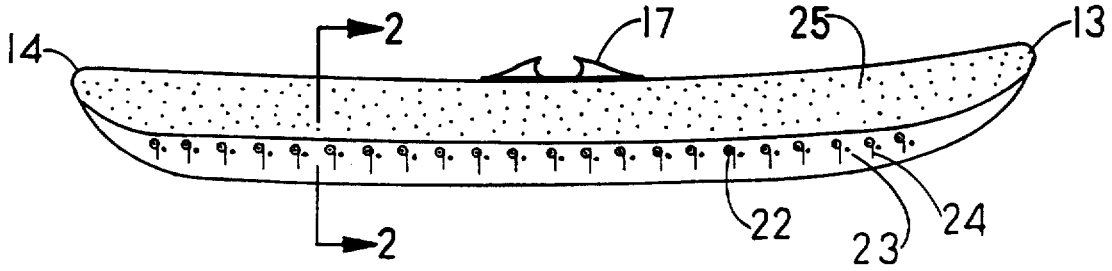
FIG. 4 shows a cross-sectional view taken across line 4—4.

FIG. 4 shows a cross section along line 4—4 thereby exposing the paddle mechanism.

Figure 5:
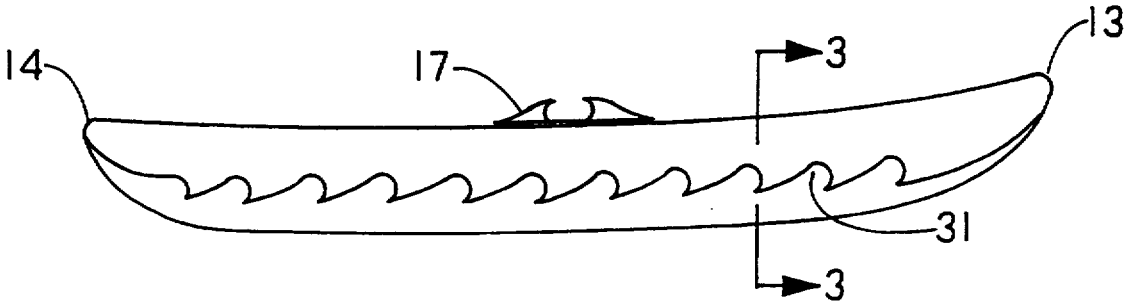
FIG. 5 shows a cross-sectional view taken across line 5—5.

FIG. 5 shows a cross section along line 5—5 thereby exposing the cupping mechanism for trapping fluid.

Figure 6:
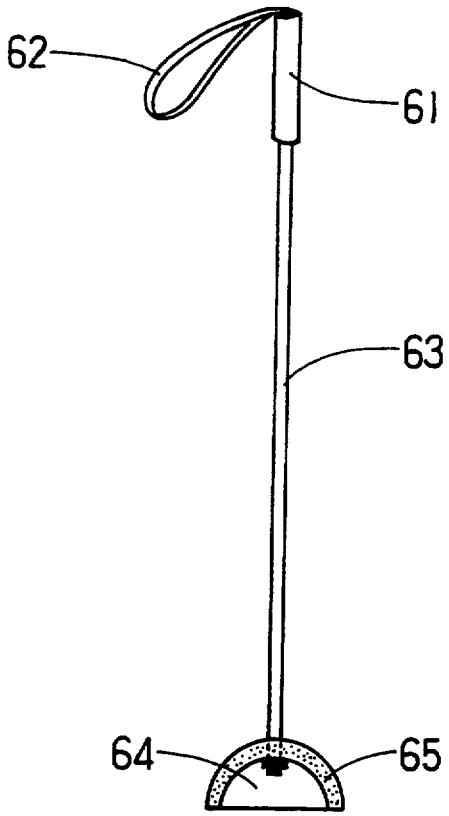
FIG. 6 shows the use of a pole with trapping device which is permanently mounted.

FIG. 6 shows a pole for assisting in propelling the personal flotation device through the fluid. A handgrip 61 similar to that for a downhill ski and a strap 62 to prevent loss of the pole are at one end of the pole. The shaft of the pole, preferably tubular, is shown as 63. The length of the shaft is variable depending upon the height of the user.

Also shown in FIG. 6 is a cupping mechanism 65 preferably filled with a buoyant material similar to that used as 25 or 32 in the personal flotation device, and covered with a hard plastic such as polyvinylchloride as is personal flotation device. A locking mechanism such as threaded bolt is shown as 64.

Figure 7:
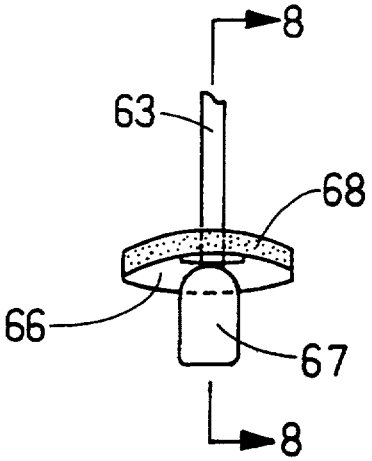
FIG. 7 shows a pole with a flotation device and a paddle.

In FIG. 7 the end of the pole is shown with a modified elliptical cupping mechanism with a lower portion thereof 66 having further located away from the handgrip end of the pole a paddle 67 for further assisting in propelling the personal flotation device.

Figure 8:
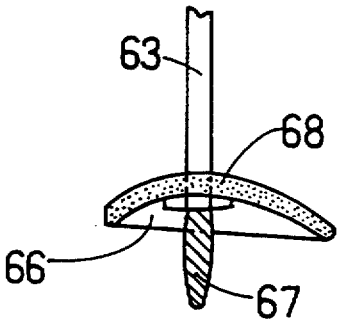
FIG. 8 shows a pole with a flotation device taken along line 8—8.

FIG. 8 shows a cross section taken along line 8—8 further describing the modified elliptical cupping mechanism. The pole 63 is conveniently set through the ellipse substantially at, or on one of the two foci of the ellipse. The handgrip 61 conveniently has finger holds (not shown) located in the same perpendicular direction as the longer portion of the modified elliptical cupping mechanism. The paddle 67 is itself conveniently arranged such that it is perpendicular to the long axis of the modified elliptical cupping mechanism.

The dimensions of the personal flotation device are largely a matter of preference. However, the following are suggested guidelines for obtaining a useful article.

The distance between the twin hulls 21 is conveniently 8 to 19 cms. The recessed area between the twin hulls 21 is conveniently 2 to 10 cms, preferably 3 to 7 cms. The overall distance between the bottom of 21 to the to the top surface 10 is 5 to 20 cms.

The overall length of the personal flotation device is conveniently 100 to 230 cms. The overall width of the personal flotation device taken at the foothold 17 is conveniently 15 to 50 cms. The paddles 24 are conveniently 2 to 7 cms from the hinged spring to the opposite end thereof.

Having fully described the present invention, the following claims which are appended, are intended to describe but not delineate the claimed invention.

What is claimed is:

1. A personal flotation device comprising an elongated member with a forward end, an aft end, a starboard side, a port side, an upper surface and a lower surface; wherein the upper and lower surfaces are disposed such that the upper surface contains means above the surface of the upper surface for restraining a human foot without confining the leg and the lower surface contains at least two rudder members running between the forward end and aft end of the device and having disposed between the rudder members cups for trapping a fluid when the device is directed in the aft direction and provided further that the rudder means are substantially parallel.

2. The personal flotation device of claim 1 wherein the means for trapping the fluid are hinged to the lower surface of the device.

3. The personal flotation device of claim 1 wherein the rudder means extend from the lower surface to a point below the lowest point of the trapping means.

4. The personal flotation device of claim 1 wherein the rudders extend from the bottom surface of the device from 2 to 10 cms.

5. The personal flotation device of claim 1 wherein the means for restraining the foot is located substantially between the rudder members.

6. The personal flotation device of claim 1 wherein the device has an overhang in relation to the means for restraining the foot such that the overhang extends outward from the starboard side when used with a right foot or outward from the port side when used with a left foot.

7. The personal flotation device of claim 6 wherein the overhang is in a non linear form.

8. The personal flotation device of claim 1 wherein the rudders are spaced from 8 to 20 cms apart.

9. The personal flotation device of claim 7 wherein the rudders are spaced from 8 to 20 cms apart.

* * * * *